US006178891B1

(12) United States Patent
Ostholt et al.

(10) Patent No.: US 6,178,891 B1
(45) Date of Patent: Jan. 30, 2001

(54) SUSPENSION MONORAIL WITH CLIMBING TROLLEY

(75) Inventors: Rüdiger Ostholt; Sigurd Volker Weber, both of Wetter (DE)

(73) Assignee: Mannesmann Aktiengesellschaft, Dusseldorf (DE)

( * ) Notice: Under 35 U.S.C. 154(b), the term of this patent shall be extended for 0 days.

(21) Appl. No.: 09/226,892

(22) Filed: Jan. 7, 1999

(30) Foreign Application Priority Data

Jan. 16, 1998 (DE) ..... 198 02 186

(51) Int. Cl.[7] ..... B61B 5/02

(52) U.S. Cl. ..... 104/93; 104/89; 105/30; 105/32; 105/33; 105/148; 105/150; 105/146

(58) Field of Search ..... 105/30, 32, 33, 105/148, 150, 146, 147; 104/89, 93

(56) References Cited

U.S. PATENT DOCUMENTS 5,092,249 * 3/1992 Knuettel ..... 105/30
5,983,803 * 11/1999 Eberle ..... 105/150

FOREIGN PATENT DOCUMENTS

2454276B2 11/1977 (DE) .
8910633 U 1/1990 (DE) .
4206493A1 6/1995 (DE) .
196 10 118 A1 * 9/1996 (DE) ..... B61B/3/02
2291074 6/1996 (FR) .
3829324 * 3/1990 (GB) ..... 105/148

* cited by examiner

*Primary Examiner*—S. Joseph Morano
*Assistant Examiner*—Frantz Jules
(74) *Attorney, Agent, or Firm*—Van Dyke, Gardner, Linn & Burkhart, LLP

(57) ABSTRACT

The invention involves a suspended trolley line, particularly an electric monorail line with at least one undercarriage movable along running rails and with a running wheel that may be driven along the rail. At least two frictional wheels are spaced from each other and positioned on the running wheel. The frictional wheels are guided on the undercarriage by a connecting element and are braced against each other by a spring element, such that the frictional wheels additionally contact the supplemental rail and impinge upon the running wheel with pressure when in an operating position. The supplemental rail is located at least partially parallel to the running rail and spaced therefrom. The driven undercarriage is simple in its construction and has improved traction characteristics and therefore is particularly capable of being used in ascending and descending sections of the trolley line. The frictional wheels, the connecting element and the spring element form an assembly unit lying on the running wheel. The assembly unit is guided by a guide element on the undercarriage such that the assembly unit is movable about the running wheel between an operating position and a neutral position. In the neutral position, a front frictional wheel moves into the clearance between the running rail and the supplemental rail, and is pivotable into the operating position by a rear frictional wheel, as the rear frictional wheel contacts the supplemental rail and subsequently pivots downward.

21 Claims, 3 Drawing Sheets

SUSPENSION MONORAIL WITH CLIMBING TROLLEY

BACKGROUND OF THE INVENTION

The invention relates to suspended trolley lines, and, more particularly, to suspension monorail trolleys.

A suspended line with an undercarriage guided along a profile rail is disclosed in German public-disclosure document DE 196 10 118 A1, published Sep. 19, 1996. The undercarriage essentially consists of a frame and a running wheel capable of being driven along the rail by an electric motor located on the frame of the undercarriage. The running wheel has a bearing surface which rolls in contact with an upper bearing surface of the profile rail to move the undercarriage along the rail. A supplemental rail is occasionally positioned parallel to the profile rail at least in areas where the profile rail deviates from horizontal. Frictional wheels are provided which roll in contact with both a surface of the supplemental rail and the bearing surface of the running wheel, thereby increasing the application force of the running wheel on the bearing surface of the profile rail and functioning as supplemental drive elements in areas where the supplemental rails are present. Two frictional wheels are provided for this which are located in front of and behind the axle of the running wheel and above the axis of the running wheel. The frictional wheels are each secured on the frame through toggle joints and are additionally connected with each other through a connecting rod connecting their axles. The connecting rod is located above the running wheel and extends in the direction of motion of the trolley. The axles of the frictional wheels are supported in the connecting rod and are movable along the rod in the direction of motion. This allows the frictional wheels, in cases of tolerance variations in the spacing between the bearing surface of the profile rail and the corresponding surface of the supplemental rail, to balance out the variations through movement towards each other or away from each other. This ensures a maintenance of the contact pressure of the running wheel on the surface of the profile rail, and of the frictional wheels on the supplemental rail. In order to achieve this, the axles of the auxiliary wheels impinge upon each other within the connecting rod through a spring element. Furthermore, the levers of the L-shaped toggle joint are connected with each other through spring elements or absorption elements, in order to avoid oscillations or vibrations of the Furthermore, the levers of the L-shaped toggle joint are connected with each other through spring elements or absorption elements, in order to avoid oscillations or vibrations of the frictional wheels when running along the supplemental rail. A secure fitting of the auxiliary frictional wheels on the running wheel should also provide for an averaging out of the contact pressure in all of the route sections of the trolley system.

SUMMARY OF THE INVENTION

The problem of creating a suspended line, especially a monorail, electric trolley line, such that the driven undercarriage has improved traction characteristics and is simultaneously simple in its construction and therefore particularly capable of being used in ascending and descending sections, is solved by the present invention.

In accordance with one aspect of the present invention, an assembly unit is provided for use on an undercarriage of a suspended trolley line. The trolley line includes a running rail, a supplemental rail positioned at least occasionally along the running rail and substantially parallel to the running rail with a spacing therebetween and at least one undercarriage. The undercarriage has a front and a rear and includes a running wheel that is at least occasionally driven along the running rail to move the undercarriage therealong. The assembly unit comprises at least two frictional wheels positioned apart from each other and contacting the running wheel, a connecting element which guides the frictional wheels on the undercarriage and a spring element which braces each of the frictional wheels against the other. The assembly unit is guided on the undercarriage by a guide element such that it is movable about the running wheel between an operating position and a neutral position. In the neutral position, a front frictional wheel is movable to provide clearance from the supplemental rail. Conversely, while in the operating position, when the undercarriage is in an area of the trolley line where a supplemental rail is present, the frictional wheels contact both the supplemental rail and the running wheel, thereby exerting a pressure upon the running wheel. The assembly unit moves into the operating position by a rear frictional wheel contacting the supplemental rail.

According to another aspect of the invention, the guide element consists of a pin element located on the connecting element and a support element located on a frame of the undercarriage and having a curved opening therealong for engagement with the pin element. The curvature of the curved opening has a radius of curvature with a center of the radius being at a carrying axle of the running wheel of the undercarriage. This allows the assembly unit to pivot about the carrying axle of the running wheel between its neutral and operating positions.

According to yet another aspect of the invention, the connecting element consists of a swinging part and an angled part. The parts are flexibly connected with each other at one end by a swivel pin. The spring element also connects an end of the angled part that is opposite the swivel pin to the swinging part. A second pin may further be located on the end of the angled part that is opposite to the swivel pin. This second pin engages a slot on the swinging part such that the angled part is pivotable relative to the swinging part.

These and other objects, advantages, purposes and features of this invention will become apparent upon review of the following specification in conjunction with the drawings.

DESCRIPTION OF THE PREFERRED EMBODIMENT

Figure 1:
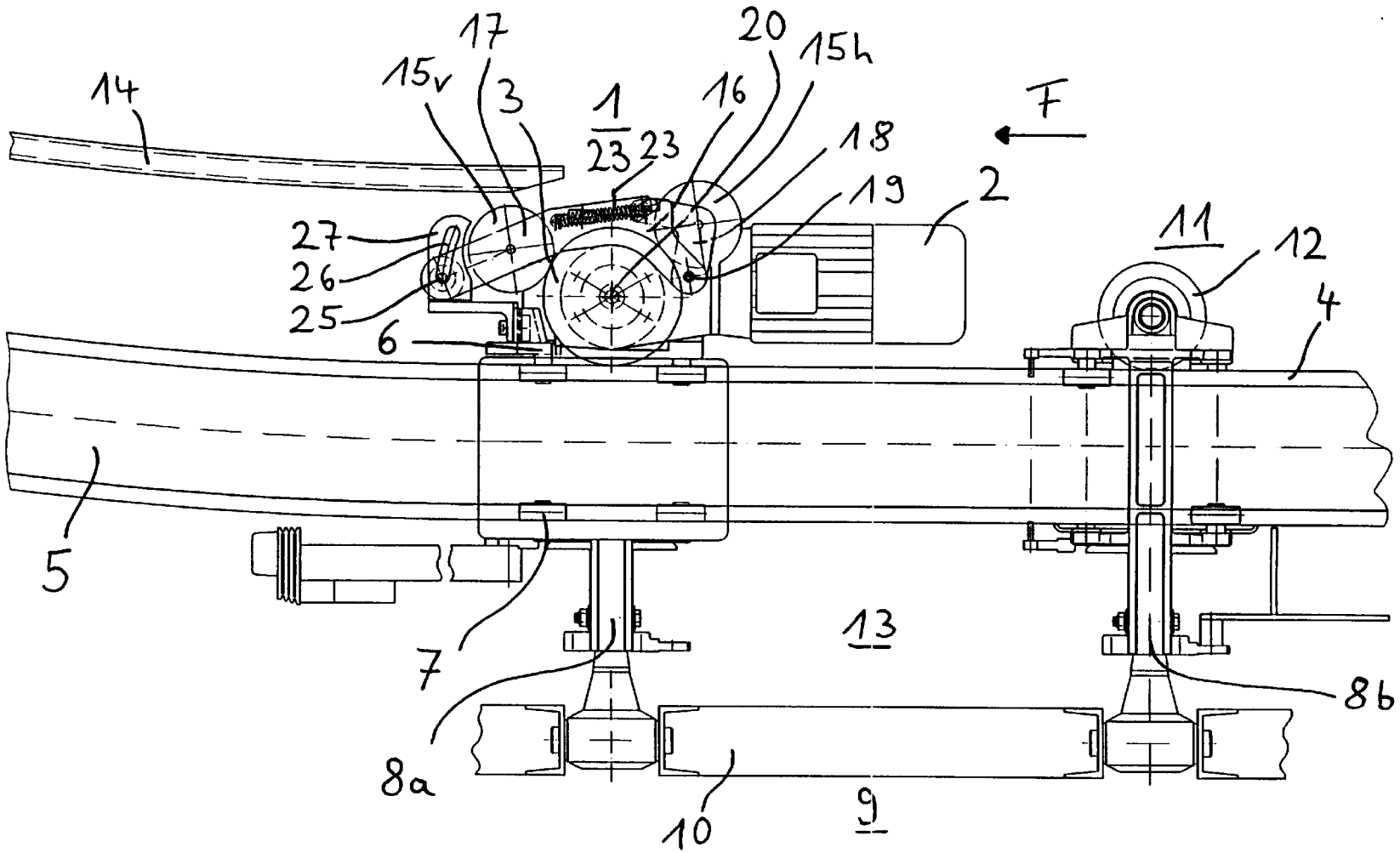
FIG. 1 shows a side view of a trolley of the present invention.

FIG. 1 shows a side view of an undercarriage and assembly unit in accordance with the present invention, incorporated in an electric suspended monorail. The suspended trolley line essentially consists of an undercarriage 1 with a drive unit 2, which may be an electric motor or the like, and which may be moved via a running wheel 3 along an upper flange 4 of an I-shaped rail 5. The drive unit 2 and the running wheel 3 are connected with each other through a frame 6. The C-shaped frame 6 extends around the rail 5 on the sides and also serves to seat a plurality of guide rollers 7, which are rotatably supported on axes and which run along the lateral edges of the upper flange 4 of the rail 5. An axle 8*a* is supported on an end of the frame 6 opposite the running wheel 3, and extends vertically downward therefrom.

The load-suspension equipment 9 includes a longitudinal spreader 10, which extends in a direction of motion F and is pivotally connected with one end to the axle 8*a*. An opposite end of the longitudinal spreader 10 pivotally is connected with a second undercarriage 11 through a second axle 8*b*, which likewise extends vertically from the second undercarriage. The second undercarriage 11 also has a C-shaped frame 6, on which guide rollers 7 and a non-driven support wheel 12, which is also rotatable around a horizontal axle transverse to the direction of motion, are supported. The two undercarriages 1 and 11 are connected to each other by the longitudinal spreader 10 between the axles 8*a* and 8*b*, and form a rail car 13 on which parts may be suspended and transported between individual stations. Undercarriages of this type are typically used to hang load-suspension equipment in order to transport automobile parts, for example, between individual manufacturing stations.

The conveyor routes formed by the rail 5 for cars 13 of this type do not typically travel in a straight line, but instead have horizontal and vertical curves therealong. In order to achieve a dependable start-up and braking of the cars while conveying a heavy load, and also to move the cars 13 through ascending and descending sections of the rail, the present invention provides a reinforcement of a friction-tight grip of the running wheel 3 on the rail 5 and an additional driving of the undercarriage 1 via frictional wheels 15 running on a supplemental rail 14. This reinforcement of the friction-tight grip takes place through a supplemental rail 14 located above and spaced from the upper flange 4 of the rail 5. The supplemental rail interacts with two frictional wheels 15 arranged so as to ride on the running wheel 3. In areas of the conveyor route which include a supplemental rail 14, the two frictional wheels 15 are in rolling contact with the underside of the supplemental rail 14 and consequently press against the running wheel 3 such that running wheel 3 is pressed onto the bearing surface of the upper flange 4 of the rail 5. The frictional wheels 15 are also pressed against the supplemental rail 14 through the countervailing force from the running wheel 3, thereby creating a type of wedging effect by the frictional wheels pressing between the running wheels and supplemental rail 14.

Figure 2:
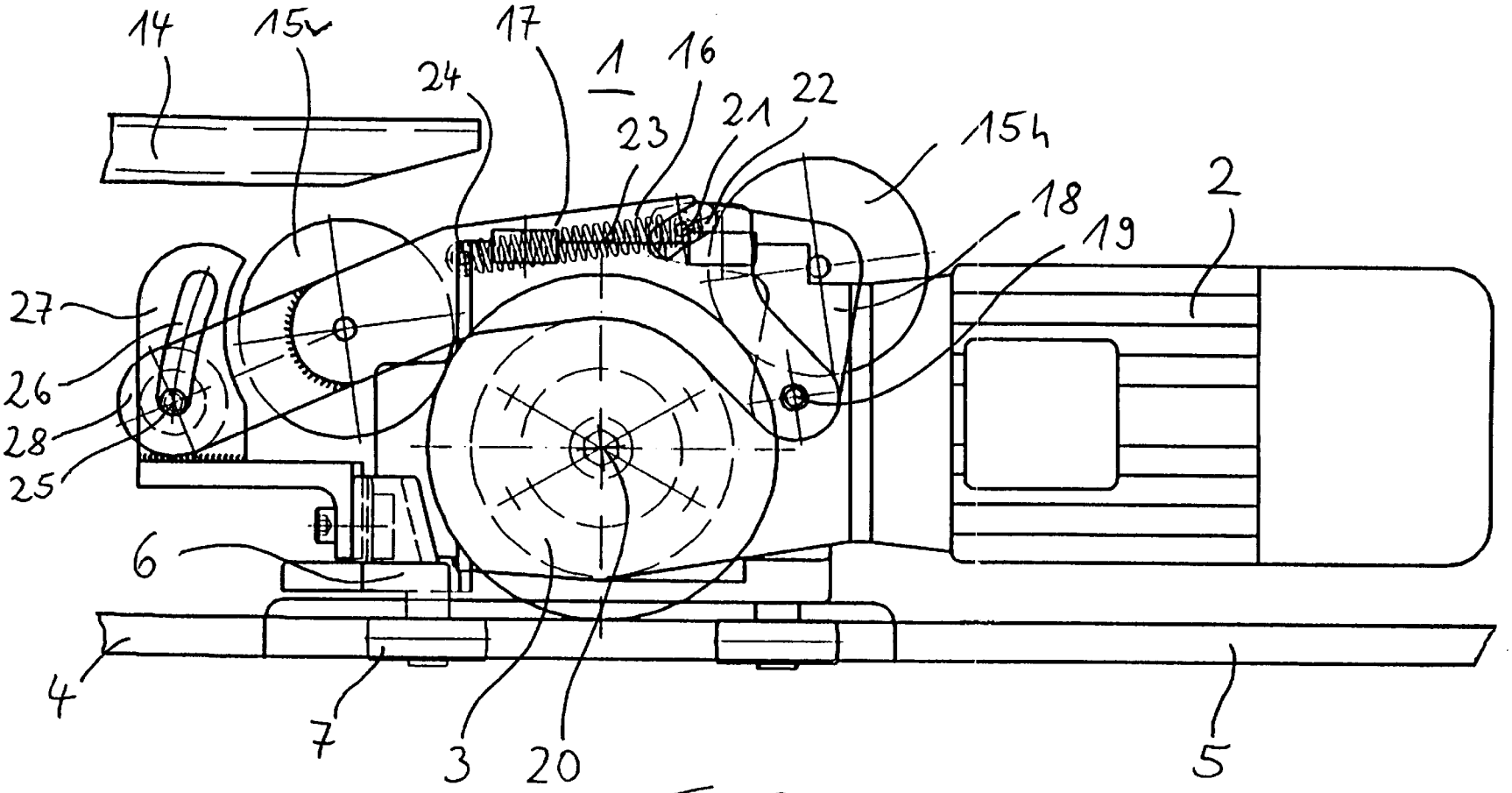
FIG. 2 shows an enlargement of a detail section from FIG. 1 in the area of the drive unit.

The frictional wheels 15 are supported on a common connecting element 16 through axles extending horizontally and crosswise to the direction of motion F, such that they may exert a force on both the running wheel 3 and the supplemental rail 14. The connecting element 16 is preferably a two-piece design which consists of a swinging part 17 and an angled part 18. The two parts are connected with each other at one end through a swivel pin or axle 19, which is aligned parallel to the carrying axle of the running wheel 3, while an end of the angled part 18 opposite to the swivel pin is also connected with a center portion of the swinging part. The swinging part 17 is generally curved, as viewed from the side, and a front frictional wheel 15*v* is supported on its front end. The end of the angled part 18 supported by axle 19 is thus pivotably secured to a rearward end of the swinging part 17 opposite the front frictional wheel 15*v*. The two legs of the angled part 18 are arranged so as to be roughly at a right angle to each other, and a rear frictional wheel 15*h* is rotatably supported in the connecting area of the two legs, or center portion, of angled part 18. The free end of the angled part 18 is guided within the swinging part 17 through a pin-slot connection, where a pin 21, extending parallel to the carrying axle 20 of the running wheel 3, is attached to the free end of the angled part 18 and guided into a slot 22, which is located in the center portion of the swinging part 17 (FIG. 2).

The orientation of the angled part 18 and swinging part 17 results in only a limited freedom of movement of the angled part 18 with respect to the swinging part 17. This freedom of movement is required for the equalization of the tolerances and variations in the distance between the supplemental rail 14 and the bearing surface of the rail 5 while the assembly unit is in an operating position, as disclosed below. The frictional wheels 15 are supported on axles aligned crosswise to the direction of motion and parallel to the axle of the running wheel 3, and positioned at the center of the angled part 18 and at the front end of the swinging part 17. It is thereby ensured that the frictional wheels 15 and the running wheel 33 are pressed between the running rail 5 and supplemental rail 14 for the transfer of driving power, even when there are variations in the distance between the running rail 5 and the supplemental rail 14.

The distance between the two frictional wheels 15 can be adjusted within a predetermined range through the guidance of the pin 21 in the slot 22. This range is selected in such a way that possible tolerance variations between the bearing surface of the upper flange 4 of the rail 5 and the inner bearing surface of the supplemental rail 14 may be balanced out by the frictional wheels 15 being able to be moved towards each other and away from each other while rolling on the running wheel 3 at the front and rear thereof. The distance between the frictional wheels 15, and consequently their position with reference to the carrying axle 20 of the running wheel 3, thus changes as the distance between the running and supplemental rails change. In order to ensure constant contact of the frictional wheels 15 on the surface of the running wheel 3 and on the supplemental rail 14, the swinging part 17 and the angled part 18 are given an initial tension against each other via a spring element 23. The spring element 23 engages the pin 21 in slot 22 at one end and further engages the swinging part 17, at a location toward the front frictional wheel 15*v* via a screw connection 24, at its other end.

In order to hold the assembly unit in its position adjacent the running wheel, with the frictional wheels rolling in contact with the running wheel, even outside of the areas with the supplemental rails running in parallel to the rail, as well as to guide it laterally in areas having a supplemental rail, the connecting element is preferably guided by a pin element 25 on the frame of the undercarriage which extends through a curved opening 26 on a guide part or support element 27. The support element 27 is attached to the frame 6 and is positioned such that the curved opening 26 has a radius of curvature which has the carrying axle of the running wheel as its center point or, in other words, the curved opening 26 is a circular arc section having its origin in the center point of the carrying axle 20 of the running wheel 3. Therefore, the assembly unit, made up of the frictional wheels 15, the connecting element 16 and the spring element 23, may pivot about the axle of the running wheel 3 in an area provided therefor, depending on the spacing available between the bearing surface of the rail 5 and the corresponding surface of the supplemental rail 14. The pin element 25 is preferably located on an extension of the connecting element 16 extending forwardly of the front frictional wheel 15*v*. This results in an arrangement of the frictional wheels 15 within the connecting element 16 that drags from the support element 27 and consequently is self-locating on the running wheel 3.

An enlargement of a detail section of FIG. 1, for the area of the running wheel 3 and the frictional wheels 15, is presented in FIG. 2, which shows that the swinging part 17 is extended out over the front frictional wheel 15*v* and that it has the pin element 25 running crosswise to the direction of motion F. Because of the connection of the swinging part 18 with the curved opening 26 via the pin element 25, it is ensured that the assembly unit, consisting of the frictional wheels 15, the connecting element 16 and the spring element 23, is held in contact with the running wheel 3, so as to ride on it, and is also laterally guided in areas of the conveyor route that are without supplemental rails 14. The frictional wheels 15 are thus capable of automatically centering themselves on the running wheel 3 because the assembly unit is guided on the frame 6 by dragging from the pin element 25 as the trolley is driven along rail 5.

Figure 3:
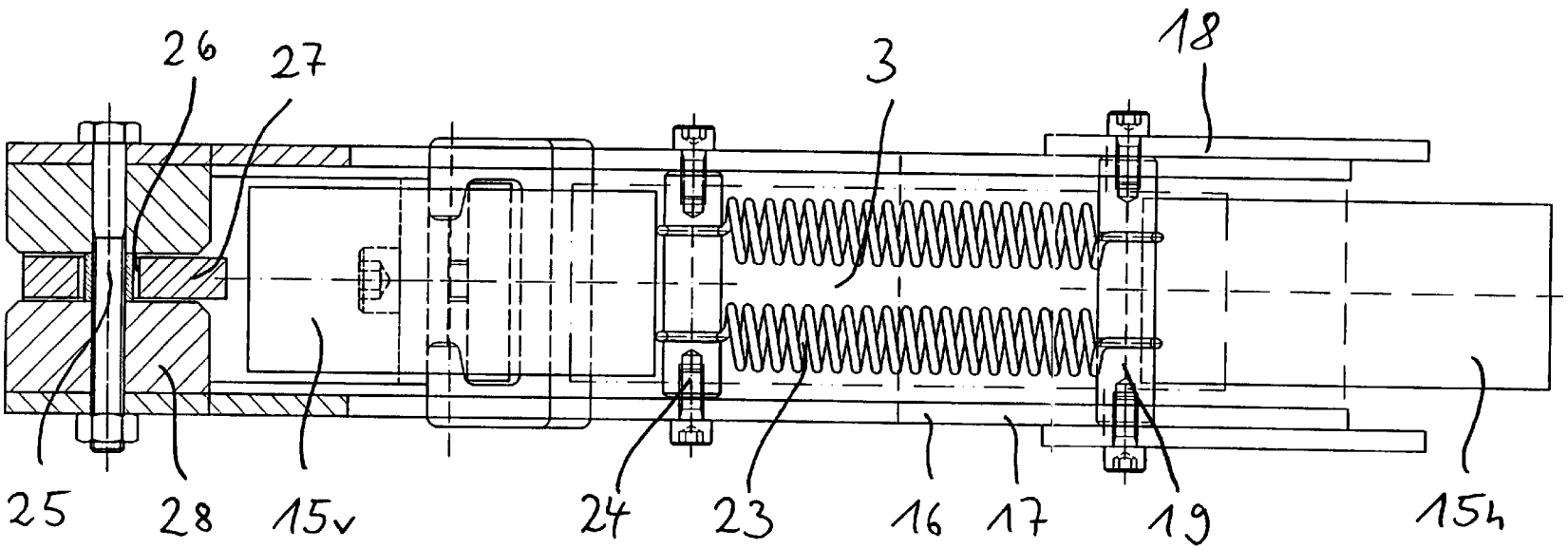
FIG. 3 shows a top view of FIG. 2.

Furthermore, as mentioned above, the curved opening 26 in support element 27 allows a pivoting movement of the assembly unit about the running wheel 3. This pivoting movement takes place between a neutral position and an operating position of the assembly unit. In the neutral position, the front frictional wheel 15*v* is located at a height, relative to the bearing surface of the upper flange 4, such that a gap remains between the supplemental rail 14 and an upper surface of the frictional wheel 15*v*. This allows the frictional wheel 15*v* to move into an area of the rail 5 with a supplemental rail 14 in a smooth manner and without initial contact with the supplemental rail 14. In this neutral position, the pin element 25 is positioned at the lower end of the curved opening 26. The neutral position of the front frictional wheel 15*v* is achieved through a counterbalancing of the assembly unit in such a way that the center of gravity of the unit is moved forwardly, in the direction of the front frictional wheel 15*v*. To accomplish this, two weight elements 28 are preferably positioned in the area of the front end of the swinging part 17 (FIG. 3). However, the assembly unit may alternatively be held in the neutral position by an additional spring element or the like.

While the front frictional wheel 15*v* is in its neutral position, the rear frictional wheel 15*h* is in its corresponding neutral position, where it is located at a level above that of the front frictional wheel 15*v*. When the undercarriage 1 moves into a section of the rail 5 with a supplemental rail 14, the surface of the rear frictional wheel 15*h* makes contact with a slanted initial section of a supplemental rail 14, and is subsequently pressed downward and between the inner surface of the supplemental rail 14 and the rail 5. As the rear frictional wheel 15*h* is pressed downward, the rear frictional wheel also simultaneously creeps rearward and the front frictional wheel 15*v* is simultaneously lifted upward so that its surface also contacts the inner surface of the supplemental rail 14. The force exerted on the frictional wheels 15 by the supplemental rail 14 is passed along to the running wheel 3 because the frictional wheels 15 impinge upon each other through the spring element 23, which prevents the frictional wheels 15 from further separating and moving downward and losing contact with the supplemental rail 14.

In cases where the distance between the bearing surface on the upper flange 4 of the rail 5 and the inner surface of the supplemental rail 14 varies, the frictional wheels 15, impinging upon each other through the spring element 23, immediately move toward each other or away from each other, and consequently balance out the change in spacing between the rail 5 and the supplemental rail 14, thereby retaining the contact pressure on both the running wheel 3 and the supplemental rail 14.

Referring now to FIG. 3, a top view of FIG. 2 is shown, where the principle structure of the connecting element 16 is best seen. The supplemental rail 14 is not depicted in this top view for reasons of clarity. The swinging part 17 and the angled part 18 are positioned on each side of the frictional wheels 15, which are supported on axles between the two respective parts of the swinging part 17 and the angled part 18. A precise guiding of the frictional wheels 15 to reinforce the friction-tight grip is consequently ensured. Furthermore, the structure and connection of the spring element 23, which is shown as two springs, is shown between the pin 21 and the screw connection 24, which further includes a pin between the two swinging parts 17. The arrangement of the weight elements 28 in the area of the pin element 25 is shown to be in the area of the front end of the swinging part 17, and located between the respective swinging parts 17. The weight elements 28 are preferably cylindrical in shape. The support element 27 is preferably connected between the weight elements 28 at the forward end of the swinging part 17, and retaining a slight gap at each side. A lateral guiding of the frictional wheels 15 on the running wheel 3 is thus additionally ensured because of the application of the flat ends of the weight elements 28 to the support element 27, which substantially precludes side-to-side travel of the frictional wheels 15 as the undercarriage 1 travels along the rail 5.

Therefore, the present invention provides an undercarriage 1 of a suspended monorail line, which is movable along a rail 5. The assembly unit is compact and simple in its construction and is provided by a combination of frictional wheels 15, a connecting element 16 and a spring element 23. The frictional wheels 15 impinge upon each other in a cushioned manner within the assembly unit, which is positionable adjacent a running wheel 3 of the undercarriage 1 from above so as to ride on the running wheel 3. The frictional wheels 15 also travel in contact with a supplemental rail 14, which is located at least partially parallel, and parallel to the extent possible, to the rail 5 for the running wheel 3, with a predetermined spacing therebetween. Ascending and descending sections, as well as a start-up and braking with heavy loads can be managed with the undercarriage of the present invention. Because of the combination of the components, which are required for reinforcement of a friction-tight grip of the running wheel on the rail, into an assembly unit, it is also possible to easily retrofit undercarriages of suspended lines that already exist.

Furthermore, it proves to be an advantage that the assembly unit can only be pivoted in a limited way about the running wheel and may be pivoted between a neutral position, in which the front frictional wheel 15*v* is at a level below the front edge of the beginning of the supplemental rail 14, and an operating position, in which both of the frictional wheels are in contact with both the running wheel 3 and the supplemental rail 14. The angular position of the connecting element 16 in its operating position is dependent upon the distance between the bearing surface of the rail 5 and the inner surface of the supplemental rail 14. In the neutral position, the rear frictional wheel is 15*h* in a raised state in contrast to the front frictional wheel 15*v*. Because of the forward-sloping arrangement of the frictional wheels 15 and the connecting element 16 in their neutral position, the undercarriage 1, which is capable of ascending along an upwardly curving rail, may travel into a route section with a supplemental rail 14 in an especially smooth and simple manner. The reinforcement of the friction-tight assembly unit pivoting to its operating position, as the front frictional wheel 15*v* consequently raises, and then presses against, the supplemental rail 14. The curved opening permits a pivoting of the assembly unit, which includes the frictional wheels 15, the connecting element 16 and the spring element 23, between the neutral and operating positions and further permits pivoting of the unit within the operating position.

An additional weight may be located on the connecting element 16 in the area of the front frictional wheel 15*v*; or, alternatively, the assembly unit may be otherwise counterbalanced in such a way that the front frictional wheel 15*v* is biased in a downward-sloping position corresponding to its neutral position during the conveyance of the undercarriage 1 along route sections without supplemental rails. For example, this position of the front frictional wheel 15*v* may alternatively be managed by an additional spring element engaging between the connecting element 16 and the frame 6 of the undercarriage.

The assembly unit of the present invention, which reinforces the friction-tight grip of the running wheel 3 on the rail 5, generally is suitable for the use on undercarriages of electric monorail trolley lines which have a rail 5 that is generally I-shaped. Each rail car, formed from two or more undercarriages and the load-suspension equipment, may be driven through vertical curves of the rail route up to an incline of approximately 10° upward from horizontal. This is possible because the frictional wheels can accordingly pivot about the running wheel to remain in contact with the supplemental rail and the running wheel, thereby maintaining pressure on the running wheel 3, while the frame of the undercarriages, as well as the spreader, are sufficiently spaced from the rail to allow the rail car to travel along such a curve.

Changes and modifications in the specifically described embodiments can be carried out without departing from the principles of the invention, which is intended to be limited only by the scope of the appended claims, as interpreted according to the principles of patent law.

The embodiments of the present invention in which an exclusive property or privilege is claimed are defined as follows:

1. An assembly unit for use on an undercarriage of a suspended trolley line, which includes a running rail, a supplemental rail positioned at least occasionally along the running rail and substantially parallel to the running rail with a spacing therebetween, and at least one undercarriage having a front and a rear and including a running wheel that is at least occasionally driven along the running rail, such that the least one undercarriage is movable along the running rail, said assembly unit comprising:

at least two frictional wheels positioned apart from each other and adapted to contact the running wheel;

a connecting element which is adapted to guide said at least two frictional wheels on the undercarriage; and a spring element which biases each of said at least two frictional wheels against the other, wherein said assembly unit is adapted to be guided on the undercarriage by a guide element such that said assembly unit is movable about the running wheel between an operating position and a neutral position, a front frictional wheel being movable to provide clearance from the supplemental rail in said neutral position, when the undercarriage is in an area of the trolley line where the supplemental rail is present, said assembly unit is in said operating position, said at least two frictional wheels being operable to contact the supplemental rail and the running wheel in said operating position, thereby exerting a pressure upon the running wheel, said assembly unit being pivotable about the running wheel in response to a rear frictional wheel contacting the supplemental rail and thereby moving said assembly unit into said operating position.

2. The assembly unit according to claim 1, wherein a second spring element is attachable to the undercarriage and engages said connecting element in an area of said front frictional wheel, said assembly unit being held in said neutral position by said second spring element.

3. The assembly unit according to claim 1, wherein the running rail is I-shaped, the undercarriage including a drive unit for driving the running wheel and a plurality of guide rollers, the guide rollers being rotatable around a plurality of vertical axles for lateral guidance of the undercarriage along the rail, the running wheel being in rolling contact with an upper flange of the running rail, and load-suspension equipment being suspended from the undercarriage.

4. An assembly unit for use on an undercarriage of a suspended trolley line which includes a running rail, a supplemental rail positioned at least occasionally along the running rail and substantially parallel to the running rail with a spacing therebetween, and at least one undercarriage having a front and a rear and including a running wheel that is at least occasionally driven along the running rail, such that the least one undercarriage is movable along the running rail, said assembly unit comprising:

at least two frictional wheels positioned apart from each other and adapted to contact: the running wheel; a connecting element which is adapted to guide said at least two frictional wheels on the undercarriage;

a spring element which biases each of said at least two frictional wheels against the other, wherein said assembly unit is adapted to be guided on the undercarriage by a guide element such that said assembly unit is movable about the running wheel between an operating position and a neutral position a front frictional wheel being movable to provide clearance from the supplemental rail in said neutral position, when the undercarriage is in an area of the trolley line where the supplemental rail is present, said assembly unit is in said operating position, said at least two frictional wheels being operable to contact the supplemental rail and the running wheel in said operating position, thereby exerting a pressure upon the running wheel, said assembly unit being movable into said operating position by a rear frictional wheel which is adapted to contact the supplemental rail; and a weight element being located on said connecting element in an area adjacent said front frictional wheel, said assembly unit being held in said neutral position outside of areas with supplemental rails by said weight element.

5. The assembly unit according to claim 4, wherein said guide element consists of a pin element located on said connecting element and a support element positionable on a frame of the undercarriage and having a curved opening for engaging said pin element, the curvature of said curved opening having a radius, said support element being positionable on the frame such that a center point of said radius is aligned with a carrying axle of the running wheel of the undercarriage.

6. The assembly unit according to claim 5, wherein said connecting element consists of a swinging part and an angled part, said swinging part and said angled part being flexibly connected with each other through a swivel pin, an end of said angled part opposite said swivel pin being connected with said swinging part through said spring element.

7. The assembly unit according to claim 2, wherein a second pin is located on said end of said angled part opposite said swivel pin, said second pin engaging a slot located on said swinging part, such that said angled part is pivotable relative to said swinging part.

8. The assembly unit according to claim 7, wherein said front frictional wheel is supported by an axle at a front end of said swinging part, said rear frictional wheel being supported by an axle in a center portion of said angled part.

9. The assembly unit according to claim 7, wherein an end of said swinging part extends beyond said front frictional wheel, said second pin being located on said end of said swinging part.

10. An assembly unit for use on an undercarriage of a suspended trolley line, which includes a running rail, a supplemental rail positioned at least occasionally along the running rail and substantially parallel to the running rail with a spacing therebetween, and at least one undercarriage having a front and a rear and including a running wheel that is at least occasionally driven along the running rail, such that the least one undercarriage is movable alone the running rail, said assembly unit comprising:

at least two frictional wheels positioned apart from each other and adapted to contact the running wheel;

a connecting element which is adapted to guide said at least two frictional wheels on the undercarriage;

a spring element which biases each of said at least two frictional wheels against the other, wherein said assembly unit is adapted to be guided on the undercarriage by a guide element such that said assembly unit is movable about the running wheel between an operating position and a neutral position, a front frictional wheel being movable to provide clearance from the supplemental rail in said neutral position, when the undercarriage is in an area of the trolley line where the supplemental rail is present, said assembly unit is in said operating position, said at least two frictional wheels being operable to contact the supplemental rail and the running wheel in said operating position, thereby exerting a pressure upon the running wheel said assembly unit being movable into said operating position by a rear frictional wheel which is adapted to contact the supplemental rail; and a second spring element attachable to the undercarriage, said second spring element being engagable with said connecting element in an area of said front frictional wheel, said assembly unit being held in said neutral position by said second spring element, said guide element consisting of a pin element located on said connecting element and a support element positionable on a frame of the undercarriage and having a curved opening for engaging said pin element, the curvature of said curved opening having a radius, said support element being positionable on the frame such that a center point of said radius is aligned with a carrying axle of the running wheel of the undercarriage.

11. The assembly unit according to claim 10, wherein said connecting element consists of a swinging part and an angled part, said swinging part and said angled part being flexibly connected with each other through a swivel pin, an end of said angled part opposite said swivel pin being connected with said swinging part through said spring element.

12. The assembly unit according to claim 11, wherein a second pin is located on said end of said angled part opposite said swivel pin, said second pin engaging a slot located on said swinging part, such that said angled part is pivotable relative to said swinging part.

13. The assembly unit according to claim 12, wherein said front frictional wheel is supported by an axle at a front end of said swinging part, said rear frictional wheel being supported by an axle in a center portion of said angled part.

14. The assembly unit according to claim 12, wherein an end of said swinging part extends beyond said front frictional wheel, said second pin being located on said end of said swinging part.

15. An assembly unit for use on an undercarriage of a suspended trolley line, which includes a running rail, a supplemental rail positioned at least occasionally along the running rail and substantially parallel to the running rail with a spacing therebetween, and at least one undercarriage having a front and a rear and, including a running wheel that is at least occasionally driven along the running rail, such that the least one undercarriage is movable along the running rail, said assembly unit comprising: at least two frictional wheels positioned apart from each other and adapted to contact the running wheel;

a connecting element which is adapted to guide said at least two frictional wheels on the undercarriage; and a spring element which biases each of said at least two frictional wheels against the other, wherein said assembly unit is adapted to be guided on the undercarriage by a guide element such that said assembly unit is movable about the running wheel between an operating position and a neutral position, a front frictional wheel being movable to provide clearance from the supplemental rail in said neutral position, when the undercarriage is in an area of the trolley line where the supplemental rail is present, said assembly unit is in said operating position, said at least two frictional wheels being operable to contact the supplemental rail and the running wheel in said operating position, thereby exerting a pressure upon the running wheel, said assembly unit being movable into said operating position by a rear frictional wheel which is adapted to contact the supplemental rail said guide element consisting of a pin element located on said connecting element and a support element positionable on a frame of the undercarriage and having a curved opening for engaging said pin element, the curvature of said curved opening having a radius, said support element being positionable on the frame such that a center point of said radius is aligned with a carrying axle of the running wheel of the undercarriage.

16. The assembly unit according to claim 15, wherein said connecting element consists of a swinging part and an angled part, said swinging part and said angled part being flexibly connected with each other through a swivel pin, an end of said angled part opposite said swivel pin being connected with said swinging part through said spring element.

17. The assembly unit according to claim 16, wherein a second pin is located on said end of said angled part opposite said swivel pin, said second pin engaging a slot located on said swinging part, such that said angled part is pivotable relative to said swinging part.

18. The assembly unit according to claim 17, wherein said front frictional wheel is supported by an axle at a front end of said swinging part, said rear frictional wheel being supported by an axle in a center portion of said angled part.

19. The assembly unit according to claim 17, wherein an end of said swinging part extends beyond said front frictional wheel, said second pin being located on said end of said swinging part.

20. An assembly unit for use on an undercarriage of a suspended trolley line which includes a running rail, a supplemental rail positioned at least occasionally along the running rail and substantially parallel to the running, rail with a spacing therebetween and at least one undercarriage having a front and a rear and including a running wheel that is at least occasionally driven along the running rail, such that the least one undercarriage is movable along the running rail said assembly unit comprising:

at least two frictional wheels positioned apart from each other and adapted to contact the running wheel:

a connecting element which is adapted to guide said at least two frictional wheels on the undercarriage: and a spring element which biases each of said at least two frictional wheels against the other, wherein said assembly unit is adapted to be guided on the undercarriage by a guide element such that said assembly unit is movable about the running wheel between an operating position and a neutral position a front frictional wheel being movable to provide clearance from the supplemental rail in said neutral position, when the undercarriage is in an area of the trolley line where the supplemental rail is present, said assembly unit is in said operating position, said at least two frictional wheels being operable to contact the supplemental rail and the running wheel in said operating position, thereby exerting a pressure upon the running wheel, said assembly unit being movable into said operating position by a rear frictional wheel which is adapted to contact the supplemental rail, said connecting element consisting of a swinging part and an angled part, said swinging part and said angled part being flexibly connected with each other through a swivel pin, an end of said angled part opposite said swivel pin being connected with said swinging part through said spring element.

21. An assembly unit for use on an undercarriage of a suspended trolley line, which includes an I-shaped running rail, a supplemental rail positioned at least occasionally along the running rail and substantially parallel to the running rail with a spacing therebetween, and at least one undercarriage having a front and a rear and including a running wheel that is at least occasionally driven along the running rail, such that the least one undercarriage is movable along the running rail, said assembly unit comprising:

at least two frictional wheels positioned apart from each other and adapted to contact the running wheel:

a connecting element which is adapted to guide said at least two frictional wheels on the undercarriage; and a spring element which biases each of said at least two frictional wheels against the other, wherein said assembly unit is adapted to be guided on the undercarriage by a guide element such that said assembly unit is movable about the running wheel between an operating position and a neutral position, a front frictional wheel being movable to provide clearance from the supplemental rail in said neutral position, when the undercarriage is in an area of the trolley line where the supplemental rail is present, said assembly unit is in said operating position, said at least two frictional wheels being operable to contact the supplemental rail and the running wheel in said operating position, thereby exerting a pressure upon the running wheel, said assembly unit being movable into said operating position by a rear frictional wheel which is adapted to contact the supplemental rail, the undercarriage including a drive unit for driving the running wheel and a plurality of guide rollers, the guide rollers being rotatable around a plurality of vertical axles for lateral guidance of the undercarriage along the rail, the running wheel being in rolling contact with an upper flange of the running rail, and load-suspension equipment being suspended from the undercarriage, the load-suspension equipment having a load spreader that is pivotably connected at one end to the undercarriage by a vertical axle and pivotably connected at another end to a non-driven undercarriage by a second vertical axle, said non-driven undercarriage having guide rollers and a support wheel.

* * * * *

UNITED STATES PATENT AND TRADEMARK OFFICE

CERTIFICATE OF CORRECTION

PATENT NO. : 6,178,891 B1 
DATED : January 30, 2001
INVENTOR(S) : Rüdiger Ostholt and Sigurd Volker Weber It is certified that error appears in the above-identified patent and that said Letters Patent is hereby corrected as shown below:

Column 1,
Lines 46-50, delete "of the Furthermore, the levers of the "L-shaped toggle joint are connected with each other through spring elements or absorption elements, in order to avoid oscillations or vibrations"

Column 6,
Lines 62-63, insert -- grip is then achieved by the rear frictional wheel as it consequently moves downward along the running wheel 3 after contacting the beginning of the supplemental rail 14. This results in the -- after "friction-tight"

Column 8,
Line 15, insert -- , -- after "line"
Line 24, delete -- : -- after "contact"
Lines 24-25, begin new paragraph at "a connecting element"
Line 32, insert -- , -- after "position"
Line 65, "Claim 2" should be -- Claim 6 --

Column 9,
Line 18, "alone" should be -- along --
Line 37, insert -- , -- after "wheel"

Column 10,
Line 12, delete -- , -- after "and" in the second instance
Line 36, insert -- , -- after "rail"
Line 66, insert -- , -- after "line"

Column 11,
Line 1, delete -- , -- after "running" in the second occurrence
Line 2, insert -- , -- after "therebetween"
Line 6, insert -- , -- after "rail"
Line 8, ":" after "wheel" should be -- ; --
Line 10, ":" after "undercarriage" should be -- ; --
Line 16, insert -- , -- after "position"

UNITED STATES PATENT AND TRADEMARK OFFICE

CERTIFICATE OF CORRECTION

PATENT NO. : 6,178,891 B1 
DATED : January 30, 2001
INVENTOR(S) : Rüdiger Ostholt and Sigurd Volker Weber It is certified that error appears in the above-identified patent and that said Letters Patent is hereby corrected as shown below:

Column 12,
Line 5, ":" after "wheel" should be -- ; --

Signed and Sealed this

First Day of April, 2003

JAMES E. ROGAN
*Director of the United States Patent and Trademark Office*